United States Patent [19]

Nishimura

[11] Patent Number: 4,792,165

[45] Date of Patent: Dec. 20, 1988

[54] PUSH LATCH DEVICE

[75] Inventor: Tamotsu Nishimura, Yao, Japan

[73] Assignee: Futaba Kinzoku Kogyo Kabushiki Kaisha, Osaka, Japan

[21] Appl. No.: 97,764

[22] Filed: Sep. 17, 1987

[51] Int. Cl.[4] ..... E05C 19/02

[52] U.S. Cl. ..... 292/19; 292/DIG. 4

[58] Field of Search ..... 292/DIG. 4, 19, 27, 292/30

[56] References Cited

U.S. PATENT DOCUMENTS

| | | | |
|---|---|---|---|
| 4,270,781 | 6/1981 | Nishimura | 292/DIG. 4 X |
| 4,482,175 | 11/1984 | Sugie | 292/DIG. 4 X |
| 4,657,291 | 4/1987 | Kurosaki | 292/DIG. 4 X |

FOREIGN PATENT DOCUMENTS 61-179277 11/1986 Japan .

*Primary Examiner*—Richard E. Moore

*Attorney, Agent, or Firm*—Armstrong, Nikaido Marmelstein & Kubovcik

[57] ABSTRACT

A push latch device composed of a case and a slider which slides into the case and out therefrom. The movement of the slider is controlled by a guide mechanism disposed between the slider and the case. The guide mechanism consists of an annular guide passageway formed in a one side inner surface of the case and a guide lever having a guide member which moves along the guide passageway while being pressed against the side wall thereof. The guide passageway is formed with a substantially V-shaped stoppage portion for stopping the slider within the case. The guide lever has a support spindle formed with a flat surface having an angle to the longitudinal direction of the guide lever to impart forces for pressing the side wall of the guide passageway, the guide lever rotating about the support spindle. The rotary moment is imparted to the guide lever by pushing the support spindle by a coil spring for moving the slider.

7 Claims, 9 Drawing Sheets

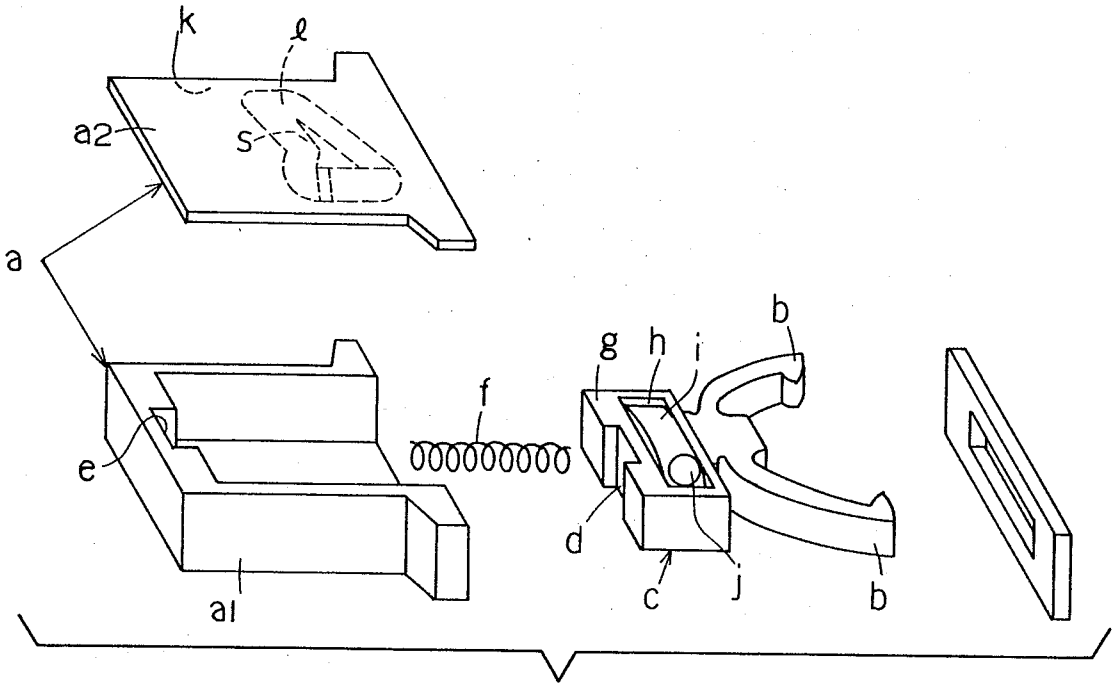
Fig.12 (A) PRIOR ART

PUSH LATCH DEVICE

BACKGROUND OF THE INVENTION

1. Field of the Invention

The present invention generally relates to a push latch device serving to open and close a door of an audio rack and a cover of a control box accommodating a variety of switches in a television set, audio appliances, etc., and more particularly, to a small-sized and inexpensive push latch device capable of operating surely and smoothly.

2. Description of the Prior Art

The push latch device is widely employed for opening and closing the door of the audio rack and the cover for protecting the control box accommodating the variety of switches in the television set and the audio appliances. The push latch device serves to open and close the door simply by pushing the door without pulling it, the arrangement being such that the door is locked by closing and then pushing it and the locking is released by pushing the door once again, thus opening it.

This type of push latch device is constructed in such a way that a slider having hooks at its tip is slidably incorporated into a case formed with an opening at its one end in association with a stoppage mechanism. Directing now attention to FIGS. 12(A) through 12(D), there is shown a one example of the push latch device. FIGS. 12(B) and 12(C) in combination show a state in which side plates of the case are removed.

More specifically, the push latch device is constructed such that a slider c provided with substantially V-shaped hooks b at its tip is incorporated into a case a consisting of a case body a1 formed with an opening extending from its one end to its side surface and of a cover member a2 for covering the one open side surface of the case body a1 so that the slider is slidable in the longitudinal direction of the case 1. A coil spring f spans from a proximal end d of the slider c to a distal end inner surface e to elastically bias the slider c towards the opening formed in the case body a1. A recession h formed in a one side surface g of the slider c accomodates a plate spring i having elastical forces acting in the depthswise direction of the recession h. A spherical body j is placed on the plate spring i so that the spherical body j is arranged to be pushed against an inner surface of the cover member a2 by dint of the plate spring i. An endless guide groove l depicted with an imaginary line in the Figure is chased in the inner surface k of the cover member a2. This endless guide groove l is, as illustrated in FIG. 12(D), constituted by: a rectilinear portion m extending straight from the opening of the case a towards the distal end thereof; a crooked portion n including a substantially V-shaped portion s which is disposed on the side of distal end and extends in continuation to the rectilinear portion m; a short rectilinear portion p continuously leading to the terminal point of the crooked portion n and extending to the mid-point in the direction of the opening formed in the case; and an inclined portion q obliquely extending towards the initial point of the rectilinear portion m. Furthermore, a step is formed at the conjunction between the rectilinear portion m and the crooked portion n for the purpose of preventing a reverse movement of the spherical body j.

When the thus constructed push latch device is practically used, this device is installed in a port of the box such as an audio rack or the like and an arrow-like engagement projection t is fitted to the inner surface of the door. On the occasion of practical use, the slider c is slid into the case a by pushing the slider c with the engagement projection t, thereby moving the spherical body j along the guide groove in the direction indicated by an arrowhead in the Figure. In the course of this movement, the spherical body j is seized by the substantially V-shaped stoppage portion s. As illustrated in FIG. 12(C), this permits the slider c to halt in a state wherein the slider is accomodated in the case a.

This type of push latch device is, however, attended with the following problems. It is needed that a depth of the guide groove l be varied by complicatedly undulating the bottom thereof to determine the direction in which the spherical body j moves. The push latch device has disadvantages of being rather costly in production and incapable of miniaturizing the device itself, because it requires a good number of components such as the plate spring i for pushing the spherical body j against the cover member a2. In an as-pressed state, the spherical body j is brought into contact with the guide groove l, and hence the frictional resistance created when the spherical body j moves becomes considerably large. In addition, the operation of the slider c is deteriorated during the practical use in some cases. Lubricants such as grease or the like are required for preventing these undesirable conditions. Moreover, there is a probability to cause the deterioration in operation, when the lubricant is consumed up or solidified.

BRIEF SUMMARY OF THE INVENTION

It is a primary object of the present invention which obviates the above-described problems to provide a push latch device which requires a small number of components, brings about a decrease in cost, can be miniaturized and causes no deterioration in operation during the practical use thereof.

To this end, according to one aspect of the invention, there is provided a push latch device wherein a guide mechanism for regulating the slide motion of a slider involves not the use of a spherical body and a plate spring but the use of a guide lever having a guide member instead of the foregoing members, and the guide member is moved along a guide passageway while being elastically biased in the direction of the surface identical with that formed with the guide passageway.

Next, a constitution of the push latch device according to the present invention will be described.

The push latch device according to the present invention is composed of a case, the slider, the guide lever and a push spring.

The case has an opening formed at one end and the annular guide passageway including a substantially V-shaped stoppage portion provided in the inner surface of a side wall thereof.

The slider is so inserted into the case as to be slidable into the case and out therefrom while being elastically biased toward the outside of the case. The tip of the slider is provided with a connecting member such as hooks, a magnet or the like. One side surface of the slider is perforated thicknesswise in an adequate position to form a support hole assuming a flat surface on the side of the opening of the case. A spring accommodation hole communicating with the support hole is formed to extend from the proximal end to the support hole in the longitudinal direction of the slider.

The guide lever consists of an arm disposed on the side surface of the slider and a support spindle passing through the support hole. The arm is provided on the one side surface of the slider, and the tip of the arm is perpendicularly provided with a guide member which moves along the guide passageway. The proximal end of the arm which stands vis-a-vis with the portion formed with the guide member is protrusively provided with a support spindle having a receiving surface inclined to the central line of the longitudinal direction (the centerline plane) of the arm.

The push spring spans from the slider to the distal end inner surface of the case in such a way that this spring is accommodated in the spring accommodation hole, and one end of the push spring is arranged to impinge upon the support surface of the guide lever.

The above-described push latch device is composed of: the guide passageway including the substantially V-shaped stoppage portion having the guide mechanism on the side of the case which serves to regulate the slide motion of the slider; and the guide lever having the guide member which moves in the same direction as that in which the guide passageway is formed. As a result of this arrangement, large frictional forces do not act on the guide member when slider moves, thereby obtaining a smooth movement of the slider. This eliminates the necessity to employ lubricants such as grease or the like, so that it is possible to prevent the deterioration in operation of the slider which is, as in the prior art, derived from complete consumption of the lubricant or the solidification thereof. The elastic forces are imparted to the guide lever by means of the push spring for pushing the slider towards the opening of the case, and a plate spring is therefore unnecessary unlike the prior art. The above-described arrangement can bring about a reduction in number of components, this further leading to a drop in cost of production.

BRIEF DESCRIPTION OF THE DRAWINGS

FIGS. 1 through 7 in combination show one embodiment of the present invention.

FIG. 1 is an exploded perspective view;

FIG. 2(A) is a plan view illustrating a state in which a door is opened by releasing an engagement projection, and FIG. 2(B) is an explanatory view of a guide groove;

FIG. 3 is a partially sectional plan view illustrating a state in which the door is closed by seizing the engagement projection;

FIG. 4 is a central cross-sectional view of FIG. 3;

FIG. 5 is a plan view of a slider;

FIG. 12(A) through 12(D) show a conventional push latch device, FIG. 12(A) is an exploded perspective view thereof, FIG. 12(B) is a plan view illustrating a state in which the door is opened by releasing the engagement projection, FIG. 12(C) is a plan view illustrating a state in which the door is closed by seizing the engagement projection, and FIG. 12(D) is an explanatory view illustrating the guide groove.

Figures 12B, 12C, 12D:
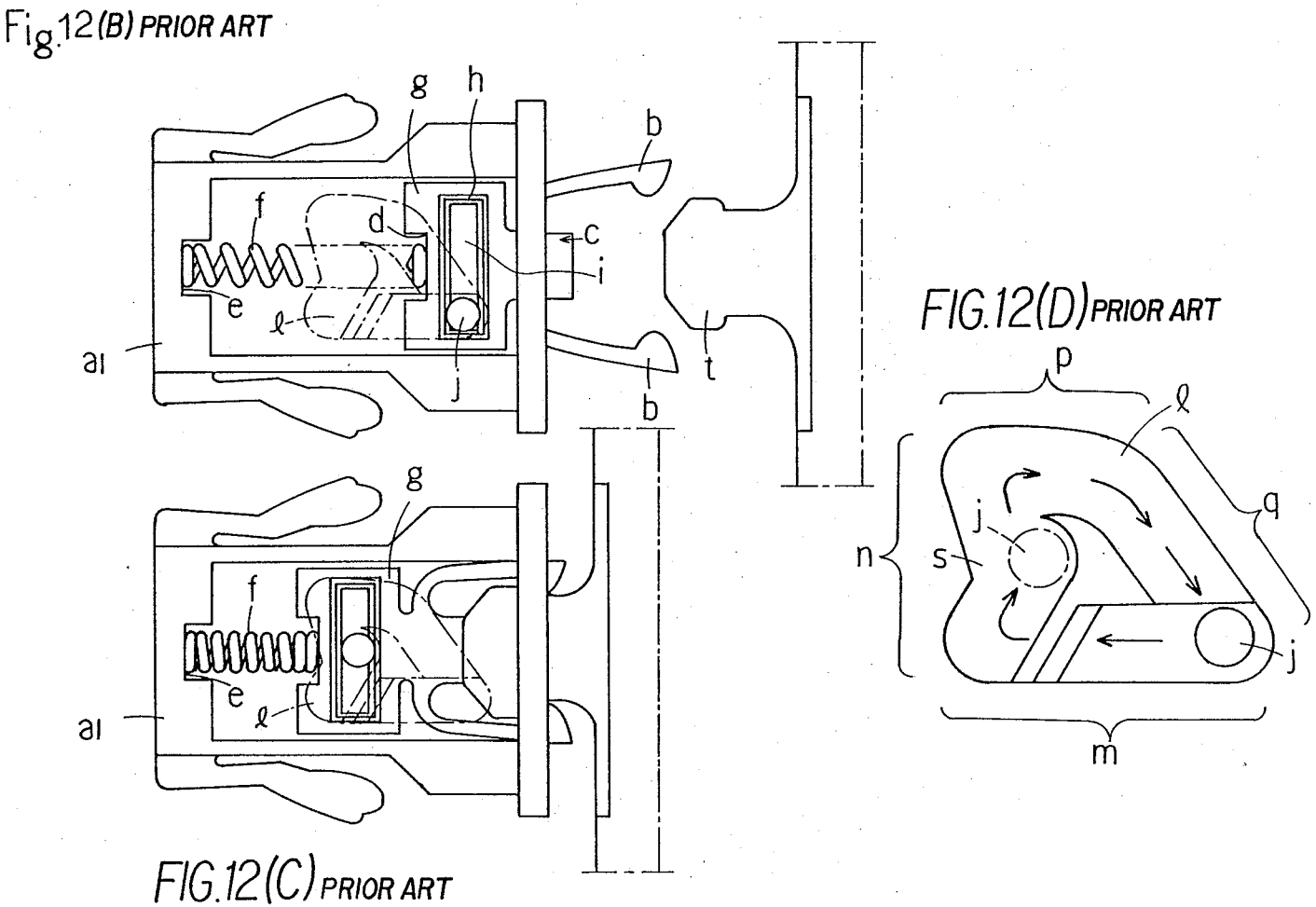
Fig.12(B) PRIOR ART
FIG.12(C) PRIOR ART
FIG.12(D) PRIOR ART

It is to be noted that FIGS. 12(B) and 12(C) show a state in which a cover member is removed.

DETAILED DESCRIPTION OF THE PREFERRED EMBODIMENTS

Figure 1:
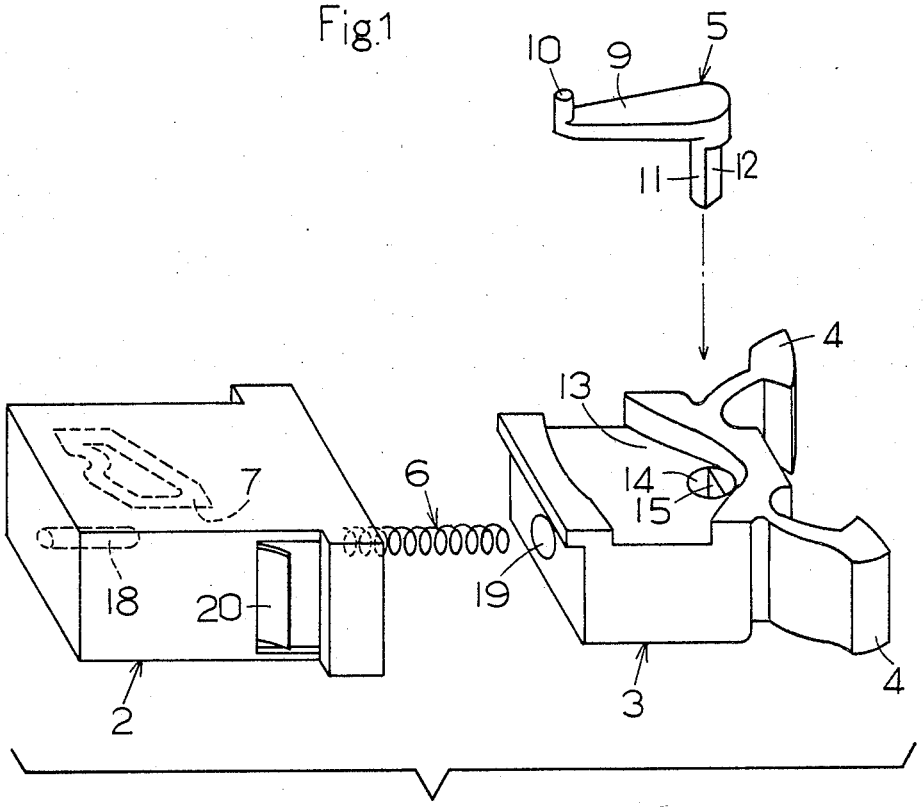
Figure 2:
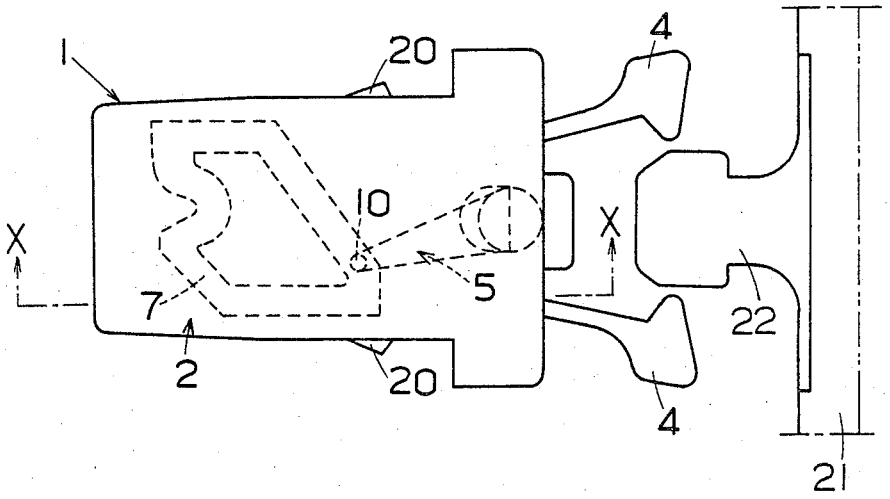
Figure 2:
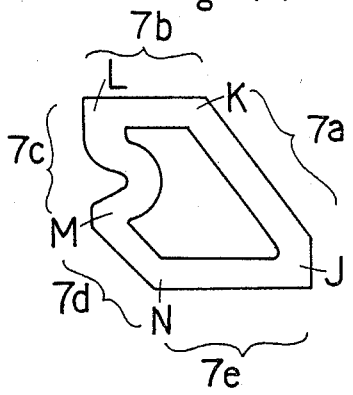
Figure 3:
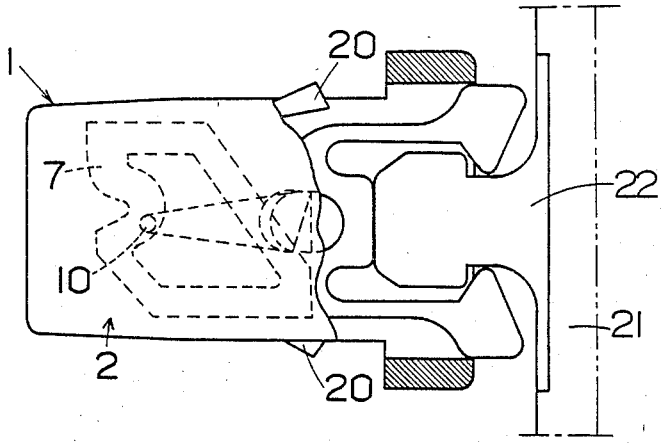
Figure 4:
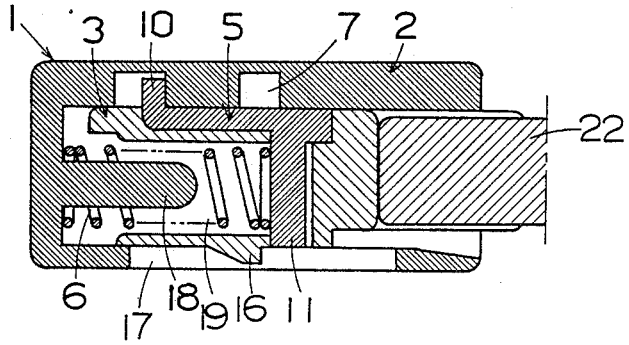

Directing now attention to FIGS. 1 through 4, there is shown one embodiment of a push latch device according to the present invention. FIG. 1 is an exploded perspective view of the push latch device. FIG. 2(A) is a plan view illustrating the push latch device when a door thereof is opened. FIG. 2(B) is an explanatory view of a guide groove. FIG. 3 is a partially cut-away view illustrating the push latch device when the door is closed. FIG. 4 is a central cross-sectional view of FIG. 3.

The push latch device generally designated 1 consists of a case 2, a slider 3, a guide lever 5 and a coil spring 6 for elastically biasing the slider 3 towards the opening of the case 2 is interposed between the distal end inner surface of the case 2 and the proximal end of the respect to the case 2 and includes hooks 4 provided at its tip portion, the hooks 4 bidirectionally branching off. The guide lever 5 mounted on one side surface of the slider 3 is disposed between the slider 3 and the case 2 to regulate the slide motion of the slider 3. The coil spring 6 for elastically biasing the slider 3 towardss the opening of the case 2 is interposed between the distal end inner surface of the case 2 and the proximal end of the slider 3. All the components except the coil spring 6 are formed of synthetic resin.

The case 2 is a box in which the opening is formed at its one end. A support rod 18 for laterally supporting the coil spring is vertically provided on the distal end inner surface of the box. Stopping members 20 for fixation protrude from both side surfaces of the box. The stopping member 20 are employed for mounting the push latch device 1 on the audio rack or the like. The stopping member 20 may, however, arbitrarily be removed. An annular guide groove 7 corresponding to the guide lever 5 is chased in the inner side surface of the case 2. This guide groove includes: a front slant portion 7*a* which is so provided on the side of the opening of the case 2 as to obliquely extend from a point J on one side to a substantially mid-point K on the other side in the direction of the distal end thereof; a rectilinear portion 7*b* extending from the substantially mid-point K to the distal end L, this rectilinear portion 7*b* serving as a going-passageway, a crooked portion 7*c* extending in continuation from the distal end L through a substantially V-shaped stoppage portion 8 to another distal end M positioned closer to the other side than a substantially central point in the crosswise direction of the case 2; a rear slant portion 7*d* stretching from the distal end M to another mid-point substantially in parallel with the front slant portion 7*a;* and another rectilinear portion 7*e* stretching straight from the mid point N to the point J defined as the initial point of the guide groove 7, this rectilinear portion 7*e* serving as a returning-passageway. The guide groove 7 assumes an annular configuration on the whole. The substantially V-shaped stoppage portion 8 which is a part of the crooked portion 7*c* is formed so that a small-width portion 7*c'* is directed to the opening of the case 2. A guide member 10 of the guide lever 5 which will be mentioned later is stoppable with respect to the small width portion 7*c'*. The guide groove 7 has the same depth throughout the entire circumference thereof.

Turning attention to FIGS. 7(A) to 7(D), there is shown the guide lever 5 provided on one side surface of the slider 3. The guide lever includes the guide member 10 loosely fitted in the guide groove 7 juts out upwards from the tip of the arm 9, while the support spindle 11 serving as a rotary spindle of the guide lever 5 projects from the proximal end of the arm 9 such as to be orthogonal to the longitudinal direction of the arm 9. The support spindle 11 includes a receiving surface 12 assuming a planar configuration in the axial direction, this receiving surface 12 being opposite to the arm 9 with respect to the axis thereof. The portion of the spindle 11 having the receiving surface 12 assumes a substantially semi-circularity in section. The receiving surface 12 has an angle of about 72° inclined to the central line in the longitudinal direction (the centerline plane) of the arm 9. The receiving surface 12 is directed to the opening of the case 2 when being inserted into the support hole 14 formed in the slider 3 which will be mentioned later.

Figure 5:
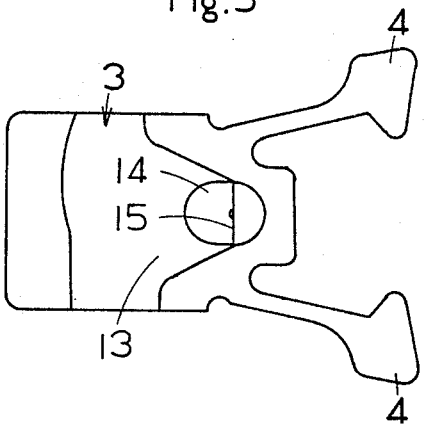
Figure 6A:
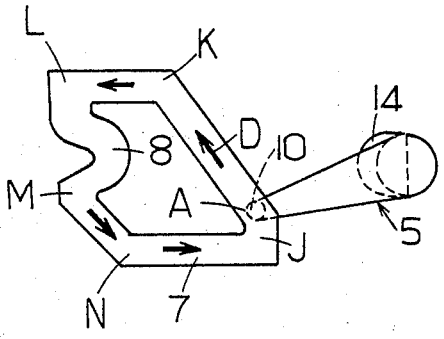
FIGS. 6(A) through 6(E) are explanatory views each showing a movement of a guide lever which moves while being guided by the guide groove.
Figure 6D:
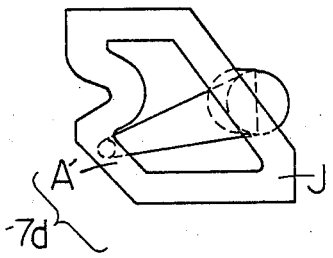
Figure 6B:
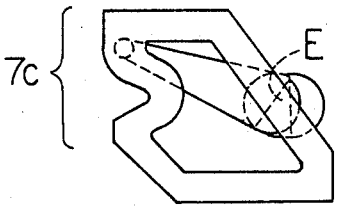
Figure 6E:
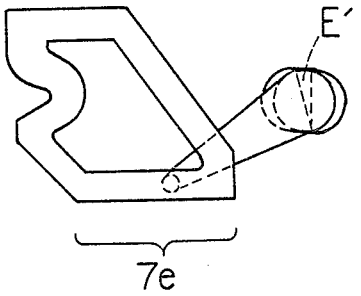
Figure 6C:
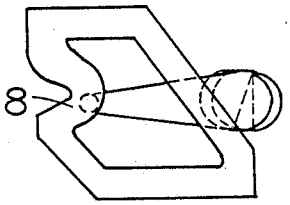
Figure 8A:
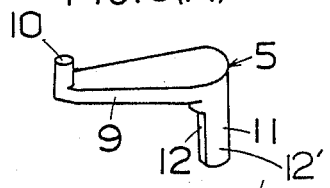
FIG. 8(A) is a perspective view of the guide lever in another embodiment of the present invention.
Figure 7A:
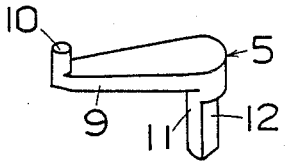
FIG. 7(A) is a perspective view of the guide lever.
Figure 8B:
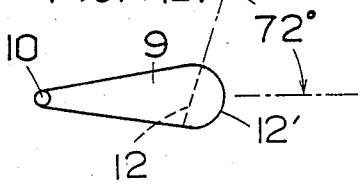
FIG. 8(B) is a plan view thereof.
Figure 7B:
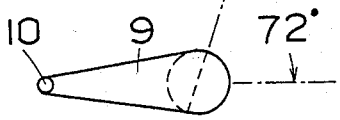
FIG. 7(B) is a plan view thereof.
Figure 8C:
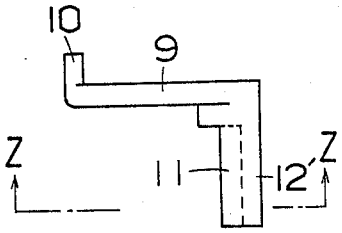
FIG. 8(C) is a front view thereof.
Figure 7C:
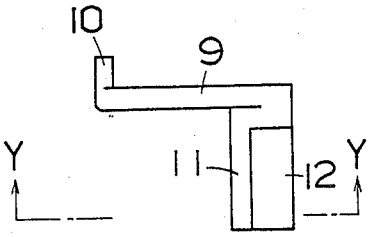
FIG. 7(C) is a front view thereof.
Figure 8D:
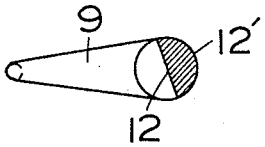
FIG. 8(D) is a sectional view taken substantially along the line Z—Z of FIG. 8(C)
Figure 7D:
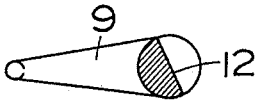
FIG. 7(D) is a sectional view taken substantially along the line Y—Y of FIG. 7(C)

The tip of the slider 3 is, as illustrated in FIG. 5, formed with hooks 4 which bidirectionally branch off. The slider 3 has an accommodation part 13 which is a fan-shaped recession suitable for accommodating the arm 9. This accommodation part 13 is formed in one side surface standing vis-a-vis with the aforementioned guide groove 7 when being incorporated into the case 2 so that its widely expanded portion is directed to the proximal end of the slider 3. The support hole 14 for receiving and supporting the support spindle 11 of the guide lever 5 is formed thicknesswise in the pivotal portion of the fan. The support hole 14 has a flat surface on the side of the opening of the case 2, i.e., on the side on which it faces the receiving surface 12 of the guide lever 5, this flat surface being orthogona1 to the direction in which the slider 3 moves. The flat surface of the support hole 14 serves as a support surface 15 suited to the receiving surface 12 of the guide lever 5.

The slider 3 is, as illustrated in the FIG. 4, formed with a spring accommodation hole 19 communicating sideways with the support hole 14, this spring accommodation hole 19 being arranged to be lengthy in the moving direction of the slider 3. The spring accommodation hole 19 accommodates the coil spring which is laterally retained by the support rod 18 vertically provided on the inner wall surface of the case 2. The support spindle 11 of the guide lever 5 is pressed by inserting one end of the coil spring 6 into the spring accommodation hole 19, thus biasing the support spindle 11 and the slider 3 towards the opening of the case 2. As a result, rotary moment is imparted to tee support spindle 11 when the slider 3 is positioned on the side of the opening of the case 2 as well as in the situation where the slider 3 is intruded into the case 2. The elastic biasing forces acting in the direction of the opening of the case 2 are imparted to slider 3.

As shown in FIG. 4, a projection 16 is formed on the side surface opposite to the side surface on which the guide lever of the slider 3 is provided. The projection 16 is loosely inserted into a slot 17 formed in the side surface of the case 2 such as to be slidable in the longitudinal direction thereof, whereby removal of the slider 3 from the case 2 can be prevented. This arrangement also permits the slider 3 to reciprocate with respect to the case 2.

Figure 11:
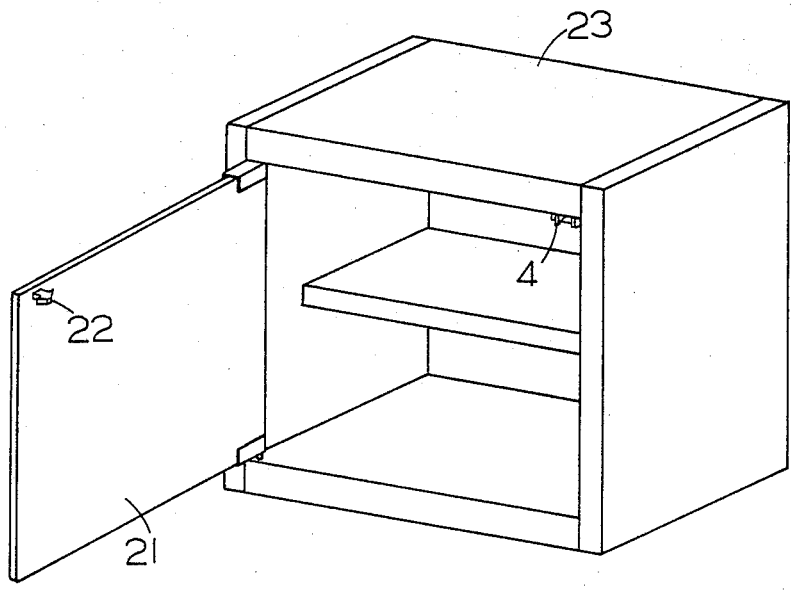
FIG. 11 is a view illustrating a state in which the push latch device according to the present invention is used.

The thus constructed push latch device 1 is employed as a mechanism for opening and closing the door of the audio rack and the cover of a control box accommodating a group of switches which are normally unused in a television set, audio appliances or the like. When being used for the audio rack, for instance, the hooks 4 are, as illustrated in FIG. 11, attached to the corner of a port of a box 23 defined as the body of the audio rack so that the hooks face a door 21. An arrow-like engagement projection 22 which corresponds in configuration to the hooks 4 are fitted to the door 21. This engagement projection 22 is sandwiched in between the hooks 4 to be seized from both sides, thus maintaining a closed state of the door 21. Upon a release of the engagement projection 22 from the hooks 4, the door 21 is opened.

The operation of the push latch device 1 according to the present invention will next be described.

FIG. 2(A) shows the push latch device 1 when the door is opened. FIGS. 6(A) through 6(E) illustrate particularly a relation between the guide groove 7 and the guide lever 5. The open state of the door 21 will hereinbelow be referred to as an initial state for avoiding the confusion in terminology. The position of the guide member 10 is called an initial position A in the initial state. In the initial state, the slider 3 is positioned on the side of the opening of the case 2, and the guide member 10 of the guide lever 5 is set in the initial position A which slightly deviates from the point J in the moving direction of the guide member 10, viz., in the direction indicated by an arrowhead D (FIG. 6(A)). The receiving surface 12 formed on the support spindle 11 of the guide lever 5 has an angle of approximately 72° inclined to the central line in the longitudinal direction of the arm 9. In the initial state, the receiving surface 12 is completely brought into contact with the support surface 15 formed on the inner surface of the support hole 14, thereby maintaining neutrality. Hence, no rotary moment acts on the guide lever 5 in this state. When a gap is created between the receiving surface 12 and the support surface 15 after the guide member 10 has deviated from the initial position A, the elastic biasing forces of the coil spring 6 act to close this gap. In consequence, the rotary moment about the support spindle 11 works on the guide lever 5.

When the slider 3 of the push latch device 1 in the initial state is pushed, resisting the elastic forces of the coil spring 6, the slider 3 is slid into the case 2, at which time the guide member 10 also moves along the guide groove 7. The support spindle 11 of the guide lever 5 continues to be pressed by the coil spring 6 in the support hole 14, and the rotary moment acts in the direction in which the gap E is formed between the receiving surface 12 and the support surface 15. Therefore, the press-forces in the crosswise direction of the case 2 with respect to the side wall of the guide groove 7 act on the guide lever 5. The guide member 10 moves in the guide groove 7 while contacting the side wall of the guide groove 7. When continuously pressing the slider 3, the guide member 10 passes through the front slant portion 7*a* and enters the rectilinear portion 7*b*. The guide member 10 then impinges upon the terminal point of the rectilinear portion 7*b* and comes in the crooked portion 7c (FIG. 6(B)). At this stage the forces thrusting the slider 3 are released. Since the slider 3 is elastically biased towards the opening of the case 2 by the coil spring 6 and the support spindle 11 undergoes the rotary moment acting in the direction in which the gap E is closed, the guide member 10 is repelled from the crooked portion, thereby moving to the substantially V-shaped stoppage portion 8. The guide member 10 which has moved to the stoppage portion 8 is elastically biased towards the opening of the case 2 by means of the coil spring 6, and hence this member 10 butts against the side wall of the stoppage portion 8. The guide member 10 is thus brought into a stoppage-state (FIG. 6(C)). FIG. 3 illustrates this state. In this way, the slider 3 is fixed in the position in which it is inserted into case 2, and the door 2 can therefore be closed. Namely, a distance between the hooks 4 is made wider than a width of the engagement projection 22 secured to the door 21 when the slider 3 is protruded, whereas the distance between the hooks 4 is narrowed by pressing the hooks 4 sideways by the side walls of the case 2 when the slider 3 has been accommodated in the case 2. The engagement projection 22 is thus seized, so that the door 21 is surely closed.

Where the closed door 21 is opened, the following steps are performed. To be specific, the slider 3 is thrust into the case 2 once again such as to be slid therein by pressing door 21. The neutral position of the guide lever 5 is even more outside (downward in the Figure) in the crosswise direction of the case 2 than the outlet of the stoppage portion 8, and hence the slider 3 is still biased outwards in the crosswise direction of the case 2. For this reason, the guide member 10 which causes the stoppage portion 8 to move in the direction indicated by the arrowhead as the slider moves escapes from the stoppage portion 8 and enters the rear slant portion 7d (FIG. 6(D)). Upon an escape of the guide member 10 from the stoppage portion 8, the slider 3 resumes its movement to the opening of the case 2 by dint of the elastically repulsive forces of the coil spring 6. The guide member loses the biasing forces acting in the crosswise direction of the case 2 when the guide member 10 moves to a position A' corresponding to the initial position A. The slider 3 is, however, biased towards the opening of the case 2, so that the guide member 10 goes through the crooked portion with no halt in the rear slant portion 7d and enters the rectilinear portion 7e. The guide member 10 further passes through this rectilinear portion 7e without the slightest delay (FIG. 6(E)). A gap E' formed between the receiving surface 12 and the support surface 15 exists on opposite side to the aforementioned gap E when passing through the rectilinear portion 7e. Meantime, the guide member 10 is biased towards the inside of the case 2, i.e., in the upper direction in the Figure. The guide member 10 which has moved away from the rectilinear portion 7e and reached the point J comes into the front slant portion 7a because of its being biased towards the inside of the case 2. The to-and-fro motion of the slider 3 in the longitudinal direction of the case 2 is restrained by the projection 16 fitted in the slot 17 formed in the case 2, and the guide member 10 therefore ceases to move just when reaching the initial position A. At this stage, the hooks 4 get out of the case 2 and expand to release the engagement projection 22, thus opening the door 21.

Where the door 21 is closed once again, the above-described operations may be repeated. As the initial position of the guide member 10 is for sure arranged to deviate a little bit from the point J to the front slant portion 7a, the guide member 10 invariably moves in the direction of an arrowhead D with no retrogression. Thus, the operation of the guide member 10 comes to completeness.

The push latch device 1 described above makes the most of the guide groove 7 and the guide lever 5 as a guide mechanism for regulating the movement of the slider 3. The guide lever 5 is pressed against the side wall of the guide groove 7 unlike a conventionally adopted arrangement wherein a bottom surface of the guide groove is pressed by a spherical body. As a result, it is feasible to offer the push latch device capable of providing the smooth movement and reducing the frictional forces created when slider moves. The minimized frictional forces require no lubricant such as grease or the like. There is no deterioration in operation which is due to the entire consumption of the lubricant or the solidification thereof. The coil spring 6 which causes the slider 3 to be slid serves to impart the biasing forces to the guide lever 5. This arrangement contributes to a decrease in number of components, miniaturization of the device and a reduction in cost.

The description of one embodiment of the push latch device according to the present invention is given above. However, other embodiments of the present invention can be considered.

For example, the slider 3 may be joined to the door 21 not by employing the hooks 4 and the engagement projection 22 but by magnetically connecting an iron piece defined as a magnetic material stuck to the corresponding door 21.

The guide lever 5 may assume such configurations as illustrated in FIGS. 8(A) through 8(D). The receiving surface 12 formed on the support spindle 11 of the guide lever 5 is provided not on the side of the opening of the case 2 but on the inside of the case 2 to permit the coil spring 6 to impinge upon this receiving surface 12. In this case, the support surface 15 stands vis-a-vis with a peripheral surface 12' of the support spindle 11 which is opposite to the receiving receiving surface 12. In this arrangement, the neutrality of the guide lever 5 implies that the receiving surface 12 comes in contact with the coil spring 6 so as to be orthogonal to the axial direction thereof. The rotary moment acts on the guide lever 5 which deviates from the neutral position as forces in the direction in which this state is corrected. As in the former case, the neutral position of the guide member 10 in the guide groove 7 is similarly set in the initial position A.

Figure 9:
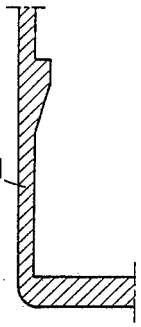
FIG. 9 is a partially sectional view, taken substantially along the line X—X of FIG. 2, of a case.

In the above-described embodiment, the guide groove 7 has the same depth throughout the overall length. It is, however, permitted that the front slant portion 7a is deepened, while the crooked portion 7c is shallowed. If such an arrangement is adopted, the guide member 10 in the guide groove 7 certainly moves in the direction of the arrowhead D in the Figure. In addition, the bottom of the rectilinear portion 7e may, as illustrated in FIG. 9, be slanted to shallow in the direction of the opening of the case 2, or a step may be formed on the way to the opening. In this configuration, the guide member 10 can move more surely in the direction of the arrowhead D.

Figure 10:
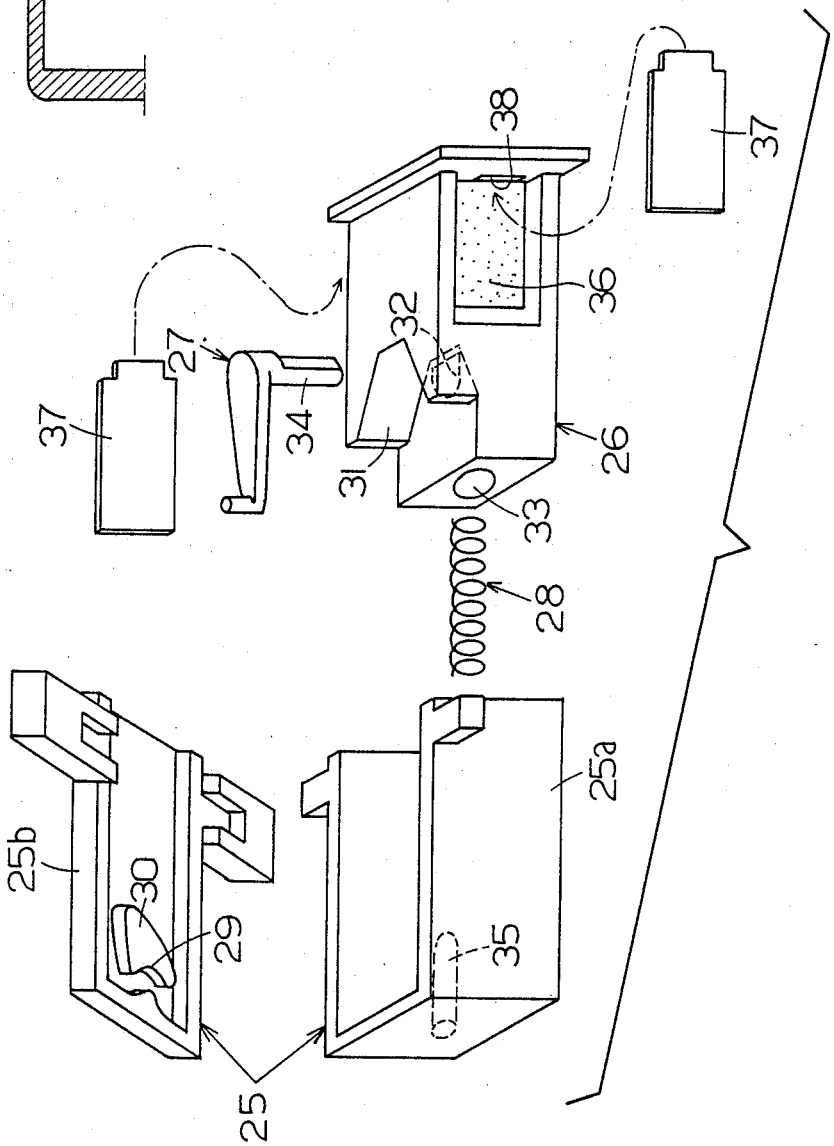
FIG. 10 is an exploded perspective view showing still another embodiment of the push latch device according to the present invention.

In the above-described embodiment, the guide member 10 is guided by the guide groove 7. It can be understood that the guide member 10 moves along the side wall of the guide groove 7 while being constantly pressed against the side wall thereof without being pressed against the bottom of the guide groove, which contrasts well with the prior art device. It is apparent from this constitution that the device according to the present invention functions in connection with the side wall for guiding the guide member 10. Hence, the object of the present invention can be accomplished by employing a protrudent portion including the substantially V-shaped stoppage portion instead of forming the guide groove having the substantially V-shaped stoppage portion 8. Referring to FIG. 10, there is shown still another embodiment in which the protrudent portion including the substantially V-shaped stoppage portion is used.

The device in this embodiment is, as in the previous embodiments, mainly composed of a case 25, a slider 26, a guide lever 27 and a coil spring 28. The case 25 has an opening formed continuously both at one end and on one side. The case 25 consists of a box-like case body 25*a* including a support rod 35 projecting from the distal end inner surface thereof and a cover 25*b* for covering the case body 25*a*. The inner surface of the cover 25*b* is formed with a guide protrudent portion having a substantially V-shaped stoppage portion 29.

The slider 3 is formed with an accommodation part 31 for accommodating the guide lever 27, a support hole for receiving and supporting a support spindle 34 of the guide lever 27 and a spring accommodation hole 33 for accommodating a coil spring 28. A magnet 36 is incorporated into the top portion of the slider 26, and iron pieces 37 are magnetically connected to both side surfaces of the magnet 36. The tip of each iron piece 37 is inserted into a slit formed in the top surface of the slider 26 to such an extent that a part of the iron piece 37 extends from the slit 38 to be exposed. This exposed portion is magnetically connected to the magnetic material attached to the door.

The arrangement relative to the guide lever 27 and the coil spring 28 is the same as that in the previous embodiment.

The case 25 is constituted by the case body 25*a* and the cover 25*b*, which considerably facilitates the formation of the above-described push latch device. The circumference of the protrudent portion which substitutes for the groove serves as a guide passageway, and hence no thin portion is shaped in the case. This enables the case to increase its mechanical strength.

As is obvious from the description given above, the guide mechanism for controlling the movement of the slider in the push latch device according to the present invention is composed of the annular guide passageway and the guide lever having the guide member which moves while being pressed against the side wall of the guide passageway in the same direction as that in which the slider moves. Unlike the prior art, it is therefore unnecessary for the spherical body to be pressed thicknesswise against the inner wall of the case at the time of movement of the slider. This brings about a considerable amount of reduction in force of friction created when the slider moves, thereby obtaining a smooth movement of the slider. Since the frictional forces decrease, no lubricant such as grease is required. As a result, it is possible to prevent the deterioration in operation which is attributed to the entire consumption of the lubricant or the solidification thereof. Moreover, according to the present invention, the rotary mount is imparted to the guide lever by means of the coil spring for elastically biasing the slider outside of the case. This arrangement leads to a decrease in number of components as compared with the prior art device. Hence, it is feasible to provide the small-sized and inexpensive push latch device.

What is claimed is:

1. A push latch device comprising:

a case including an annular guide passageway having a substantially V-shaped stoppage portion formed in the inner surface of the side wall, said case having an opening formed in one end thereof;

a slider inserted in said case while being elastically biased toward the outside of said case so as to be inwardly and outwardly slidable with respect to said case, said slider having a tip portion provided with a connecting member a main body, a support hole formed in one side surface of said main body extending through said body, a surface of said support hole on the side of said opening of said case being made flat, and a spring accommodation hole formed lengthwise, of said main body and a communicating with said support hole;

a guide lever including: a guide member which is vertically provided at the tip of an arm disposed on said one side surface of said slider standing vis-a-vis with said guide passageway and moves along said passageway; and a support spindle protrusively provided at a proximal end of said arm provided on the surface opposite to the surface provided with said guide member, said support spindle having a flat receiving surface inclined to a centerline plane of said arm; and a push spring interposed between a distal end inner surface of said case and said slider in such a state that said push spring is accommodated in said spring accommodation hole, said push spring having its one end which impinges upon a support surface of said guide lever.

2. A push latch device as set forth in claim 1, wherein an annular groove having said substantially V-shaped stoppage portion is formed in the side wall inner surface of said case, and said groove serves as a guide passageway.

3. A push latch device as set forth in claim 1, wherein a protrudent portion having said substantially V-shaped stoppage portion is formed on the side wall inner surface of said case, and the circumference of said protrudent portion serves as a guide passageway.

4. A push latch device as set forth in claims 2 or 3, wherein said receiving surface of said support spindle is formed on the side opposite to said guide member in a longitudinal direction of said arm.

5. A push latch device as set forth in claim 3, wherein said receiving surface of said support spindle is formed on the side of said guide member in a longitudinal direction of said arm.

6. A push latch device as set forth in claims 2 or 3, wherein said receiving surface of said spindle has an angle of approximately 72° inclined to the centerline plane said arm.

7. A push latch device comprising:

a case including a case body having an opening formed continuously both at one end and one side thereof and a cover having a guide protrudent portion which is formed on its inner surface and subsumes a substantially V-shaped stoppage portion, said cover being put on said case, the circumference of said guide protrudent portion serving as a guide passageway;

a slider inserted into said case while being elastically biased toward the outside of said case so that said slider is inwardly and outwardly slidable with respect to said case, said slider having: a tip portion fitted with a magnetic material on the side of said opening of said case, a main body, a support hole formed in one side surface of said main body and extending through said body, a surface of said support hole being made flat on the side of said opening of said case, and a spring accommodation hole formed lengthwise of said main body and communicating with said support hole;

a guide lever including a guide member which is vertically provided at the tip of an arm disposed on said one side surface of said slider standing vis-a-vis with said guide protrudent portion and moves along the circumference of said guide protrudent portion while being pressed sideways against the circumference thereof, and a support spindle protrusively provided at the proximal end of the opposite surface of said arm to the surface provided with said guide member, said support spindle having a flat receiving surface inclined to a centerline plane of said arm;

a push spring interposed between the distal end inner surface of said case and said slider in such a state that said push spring is accommodated in said spring accommodation hole, said push spring having its one end which impinges upon a support surface of said guide lever.

* * * * *